United States Patent [19]

Guenther

[11] 4,083,331

[45] Apr. 11, 1978

[54] INTERNALLY COOLED ROTARY EXHAUST VALVE

[75] Inventor: William D. Guenther, Hagerstown, Ind.

[73] Assignee: Dana Corporation, Toledo, Ohio

[21] Appl. No.: 737,601

[22] Filed: Nov. 1, 1976

[51] Int. Cl.[2] ..... F01P 3/02; F01N 3/02; F01P 9/02

[52] U.S. Cl. ..... 123/41.17; 60/317; 60/318; 60/320; 123/41.4; 123/41.73

[58] Field of Search ..... 123/41.17, 41.4, 41.73; 60/318, 320, 317

[56] References Cited

U.S. PATENT DOCUMENTS

| | | | |
|---|---|---|---|
| 1,731,016 | 10/1929 | Lehman | 123/41.4 |
| 2,041,160 | 5/1936 | Zahodiakin | 123/41.17 |
| 2,429,304 | 10/1947 | Aspin | 123/41.73 |
| 2,498,846 | 2/1950 | Ball | 123/41.4 |
| 2,742,026 | 4/1956 | French | 123/41.4 |
| 3,350,879 | 11/1967 | Boda et al. | 60/320 |
| 3,621,652 | 11/1971 | DeMaree | 60/320 |

FOREIGN PATENT DOCUMENTS

| | | | |
|---|---|---|---|
| 121,602 | 10/1946 | Australia | 123/41.4 |
| 1,436,597 | 3/1966 | France | 60/318 |

*Primary Examiner*—Charles J. Myhre
*Assistant Examiner*—Sheldon Richter
*Attorney, Agent, or Firm*—Robert E. Pollock; Robert M. Leonardi; Richard D. Emch

[57] ABSTRACT

An improved water cooled exhaust valve structure is disclosed for a rotary valve engine. The exhaust gases from an engine combustion chamber enter a side port in a rotary exhaust valve and flow axially through the valve to an exhaust outlet. Cooling water is sprayed axially into the exhaust valve and is directed in the gas flow direction from a location upstream of the side port. A novel deflector prevents the cooling water from entering the side port.

5 Claims, 5 Drawing Figures

INTERNALLY COOLED ROTARY EXHAUST VALVE

This invention relates to engines and more particularly to an improved water cooled rotary exhaust valve for external and internal combustion engines.

On type of spark ignited internal combustion engine has rotary valves for supplying a fuel/air charge to a combustion chamber and for exhausting the products of combustion from the chamber. Since the exhaust gases are at combustion temperatures, it is necessary to prevent overheating of the exhaust valve. The temperature of the exhaust valve must be limited to permit it to rotate freely within a cylinder head in which it is mounted while at the same time maintaining close tolerances between the valve and the cylinder head. Close tolerances must be maintained not only when the engine is at operating temperatures, but also when the engine is cold during initial start up. Cooling has been accomplished in the past by circulating a liquid coolant through passages located in the cylinder head near the rotary exhaust valve. In U.S. Pat. No. 1,731,016 which issued Oct. 8, 1929, it also is taught that a rotary valve can be cooled internally by spraying water into a hollow passageway extending axially through the valve. This passageway is separate from exhaust gas passageways. As the water spray strikes the interior of the hot valve, it flashes into steam which is carried through a closed system to a condensor and then circulated back to water spray nozzles within the valve. Although this arrangement is effective to cool the rotary exhaust valve, it is ineffective as a means for cooling the exhaust gases since heat from the exhaust gases must be conducted through the valve walls before it is dissipated by the cooling water.

The prior art also suggests that exhaust gases from a conventional internal combustion engine may be cooled directly by a water spray. U.S. Pat. No. 3,530,665 which issued Sept. 29, 1970, for example, discloses spraying water into an engine exhaust pipe to cool the exhaust pipe and to wash the exhaust gases. The gases are circulated through a scrubber which removes solids and excess water. By cooling the exhaust gases near the engine, the efficiency of the engine is increased since the exhaust back pressure at the engine is reduced.

In the past, it has not been practical to directly water cool exhaust gases within a rotary exhaust valve operated in an internal combustion engine. Difficulty has occurred from the water and exhaust solids penetrating the region between the rotary valve and the cylinder head or valve housing. This eventually causes a failure of the seals and bearings for the rotary exhaust valve.

According to the present invention, water is sprayed into an axial passage extending through the center of a rotary exhaust valve for cooling both the valve and the exhaust gases during operation of an internal combustion engine. The engine is particularly suitable for use as a marine outboard engine since there is an available supply of coolant and the coolant from the engine and the exhaust gases may be discharged together into a body of water.

The engine generally includes at least one piston mounted to reciprocate within a cylinder. A combustion chamber is defined between the piston, the cylinder and a cylinder head. Rotary intake and exhaust valves are mounted to rotate within the cylinder head. Rotation of the valve is synchronized to provide a fuel/air charge through a side port in the intake valve to the combustion chamber and to exhaust gases from the combustion chamber through a port in the exhaust valve at appropriate times in the engine cycle. Exhaust gases flow from a side port in the exhaust valve axially down a passageway to an exhaust outlet at or adjacent one end of the valve. Preferably, two diagonally opposing side ports are provided in the exhaust valve for each cylinder. The exhaust valve is rotated at a speed such that each side port functions for exhausting gases from the combustion chamber on alternate cycles. A nozzle for spraying cooling water is located within the exhaust valve upstream of the side ports. The nozzle is directed for spraying coolant in the same direction in which the exhaust gases flow from the side ports to the outlet. Each exhaust side port is covered by a flame or exhaust gas deflector which is positioned in the valve passageway to direct exhaust gases downstream toward the exhaust outlet. The deflector prevents the exhaust gases flowing through either side port from entering the diagonally opposing side port. Preferably a coolant deflector is mounted to extend over the flame deflector to provide a double wall structure such that the exhaust gas deflector is not cooled excessively. This allows the flame deflector to operate at sufficiently high temperatures to prevent carbon deposits. The coolant deflector extends from upstream of the side ports around sides of the flame deflector to prevent the cooling water spray from entering either of the two diagonally opposing exhaust side ports. As a consequence, the valve is cooled along its length and the cooling water spray and the exhaust gases mix downstream from the two diagonally opposing ports for cooling the exhaust gas without fouling the seals and bearings for the rotary exhaust valve.

Accordingly, it is an object of the present invention to provide an improved engine having a rotary exhaust valve.

Another object of the invention is to provide an improved engine having a rotary exhaust valve in which both the exhaust valve and the exhaust gases are water cooled.

Other objects and advantages of the invention will become apparent from the following detailed description, with reference being made to the accompanying drawings.

Figure 1:
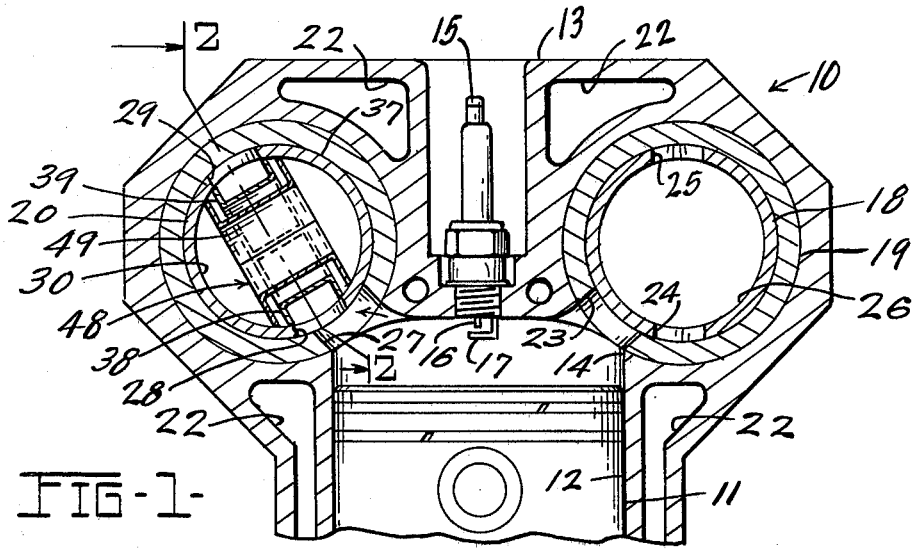
FIG. 1 is a fragmentary vertical cross sectional view through one cylinder of an engine having rotary intake and exhaust valves, such view extending perpendicular to the axes of the rotary valves.
Figure 2:
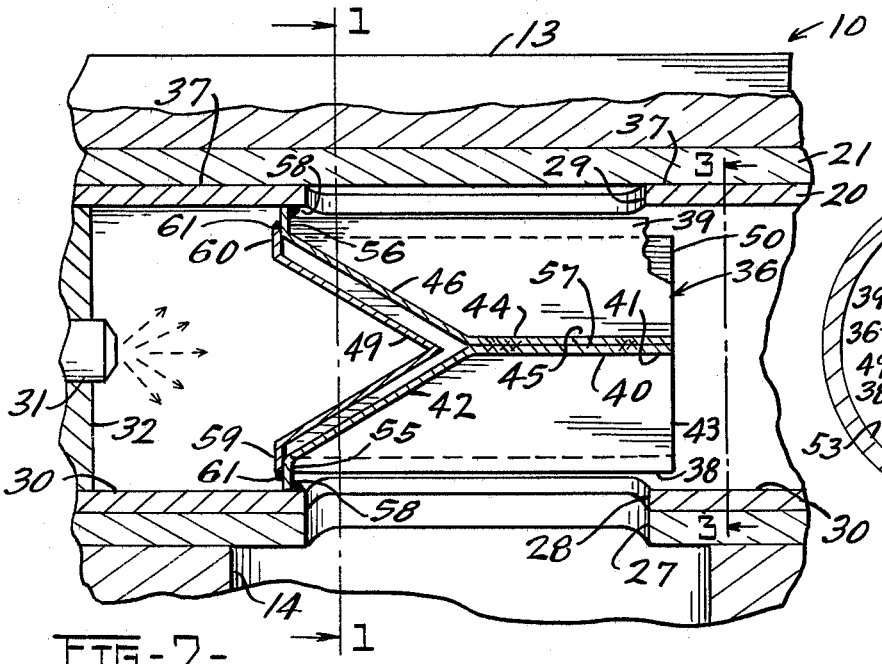
FIG. 2 is a fragmentary cross sectional view taken along line 2—2 of FIG. 1, and extending through a coolant and exhaust gas deflector.

Turning now to the drawings and particularly to FIGS. 1 and 2, a fragmentary portion of an internal combustion engine 10 is shown in cross section. The engine 10 includes a piston 11 which reciprocates within a cylinder 12 in a conventional manner. A cylinder head 13 encloses the cylinder 12 opposite the piston 11 for defining a combustion chamber 14. A spark plug 15 is mounted on the cylinder head 13 such that a pair of electrodes 16 and 17 on the spark plug 15 define a spark gap within the combustion chamber 14. A rotary intake valve 18 is mounted to rotate within a sleeve 19. Similarly, a rotary exhaust valve 20 is mounted to rotate within a sleeve 21. The engine 10 is also provided with a plurality of passages 22 adjacent the cylinder 12 and within the head 13 through which a coolant is circulated in a conventional manner for controlling the temperature of the engine 10.

The sleeve 19 is provided with a side port 23 which opens into the combustion chamber 14, and the rotary intake valve 18 is provided with two diagonally opposing side ports 24 and 25. A fuel/air charge is supplied from a carburetor or other suitable means to an interior passageway 26 extending axially through the rotary intake valve 18. During each 180° increment through which the intake valve 18 is rotated, one of the side ports 24 or 25 will rotate through an angular segment in which it overlaps the side port 23 in the sleeve 19 for delivering a fuel/air charge to the combustion chamber 14.

The sleeve 21 in which the rotary exhaust gas valve 20 is mounted also includes a side port 27 which connects with the combustion chamber 14, and the rotary exhaust valve 20 includes two diagonally opposing side ports 28 and 29. Each time one of the side ports 28 or 29 is rotated to a position overlapping the port 27 in the sleeve 21, exhaust gases are vented from the combustion chamber 14 through such port 28 or 29 into an interior passageway 30 which extends axially through the rotary exhaust valve 20. The exhaust gases flow axially through the exhaust valve passage 30 to either a side port or, preferably, an end port (not shown) which connects to an exhaust pipe. It will be noted that the intake valve 18 is provided with two diagonally opposing ports 24 and 25 and the exhaust valve 20 is provided with two diagonally opposing ports 28 and 29. The structure of the valves 18 and 20 may be modified by eliminating one of the diagonally opposing side ports in each valve. In this case, it is necessary to rotate the valves 18 and 20 twice as fast to provide intake and exhaust cycles in synchronism with reciprocation of the piston 11.

Referring now specifically to FIG. 2, a fragmentary cross sectional view is shown extending in an axial direction through the rotary exhaust valve 20 and the sleeve 21. The valve 20 is positioned with the port 28 in alignment with the port 27 in the sleeve 21 for exhausting gases from the combustion chamber 14. A nozzle 31 is mounted in an end 32 of the valve 20 upstream of the ports 28 and 29. A liquid coolant, such as lake water in the case of an outboard marine engine, is sprayed from the nozzle 31 into the passage 30 and is directed in a downstream direction, as determined by the flow direction of exhaust gases through the passage 30. The coolant sprayed from the nozzle 31 functions for cooling the valve 20 and also is mixed directly with the exhaust gases flowing through the passage 30 for cooling and condensing such gases. By cooling and condensing the exhaust gases, the back pressure within the passage 30 in the exhaust valve 20 is reduced to in turn increase the operating efficiency of the internal combustion engine 10. Water sprayed from the nozzle 31 is vaporized as it contacts the valve 20 and as it mixes with the exhaust gases and is carried by the exhaust gases from the passage 30. Preferably, the operation of the nozzle 31 is controlled in response to the temperature of the exhaust valve 20 to prevent spraying of the liquid coolant until after the exhaust valve 20 reaches a predetermined high temperature. This prevents the buildup of excessive moisture within the passage 30. After the engine 10 reaches operating temperature, the spraying of coolant from the nozzle 31 may also be controlled in response to the speed of and load on the engine 10.

Figure 3:
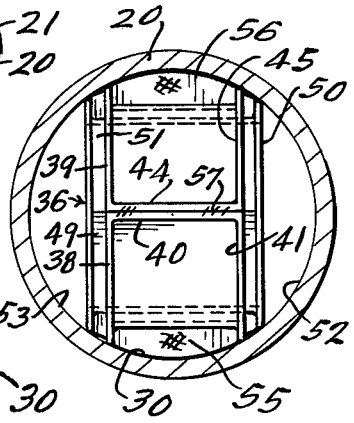
FIG. 3 is a cross sectional view taken along line 3—3 of FIG. 2, and showing an end view of the coolant and exhaust gas deflector.
Figure 5:
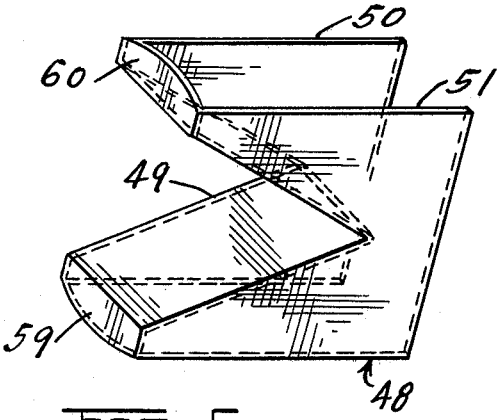
FIG. 5 is a perspective view of the coolant deflector with the exhaust gas deflectors removed.
Figure 4:
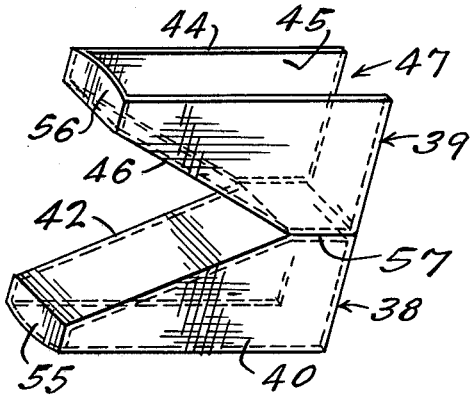
FIG. 4 is a perspective view of the flame or exhaust gas deflecting portion of the deflector with the coolant deflector removed.

A deflector 36 is positioned within the passage 30 between the two diagonally opposing exhaust ports 28 and 29. The deflector 36 serves several functions. As exhaust gases flow through either of the ports 28 or 29 in the exhaust valve 20, the deflector 36 prevents such gases from entering the opposing port 29 or 28 and penetrating an interface 37 between the exhaust valve 20 and the sleeve 21. It should be appreciated that a seal must be maintained between the valve 20 and the sleeve 21 to maintain compression within the combustion chamber 14 for efficient operation of the engine 10. If the hot exhaust gases flowing through either of the ports 28 or 29 should enter the opposing port 29 or 28, there may be a premature failure of the seal at the interface 37 due to erosion caused by the hot exhaust gases and abrasion from solids or debris within the exhaust gases. The deflector 36 also functions to prevent coolant from the nozzle 31 from entering the combustion chamber 14 and from entering the interface 37 between the exhaust valve 20 and the sleeve 21 to protect the seals for the exhaust valve 20. As shown in FIGS. 1–5, the deflector 36 includes at least an exhaust gas or flame deflector section 38 positioned over the side port 28 and an exhaust gas or flame deflector section 39 positioned over the side port 29. The deflector section 38 is generally in the form of a somewhat tubular shell stamped from metal and having a side wall 40 which defines a chamber 41 over the side port 28. The chamber 41 may be square in cross section, as shown in FIGS. 1 and 3 or curved in cross section. The upstream end of the chamber 41 is closed by an angled end wall 42 which directs exhaust gases flowing through the port 28 through the chamber 41 toward an outlet 43 which is directed axially down the valve passage 30. The outlet 43 is located sufficiently downstream from the side port 28 to prevent exhaust gases flowing through the side port 28 from entering the diagonally opposing side port 29. Similarly, the exhaust gas deflector section 39 includes a tubular side wall 44 which extends over the side port 29 for defining a chamber 45. An angled end wall 46 is connected between the side wall 44 and the wall of the passage 30 upstream of the side port 29 for directing exhaust gases flowing through the side port 29 toward an outlet 47 from the chamber 45. Gases flowing from the outlet 47 are directed axially downstream through the valve passage 30 toward the exhaust gas outlet. Again, the outlet 47 extends sufficiently downstream of the side port 29 for preventing gases flowing through the side port 29 from entering the diagonally opposing side port 28.

To prevent excessive carbon buildup on the flame deflector sections 38 and 39, it is desirable to have the deflector sections 38 and 39 operate at "red hot" temperatures. The deflector sections 38 and 39 are stamped from a high temperature stainless steel, or other material which will not corrode or erode excessively at high operating temperatures. Although coolant sprayed from the nozzle 31 may be deflected away from the side ports 28 and 29 by the end walls 42 and 46 of the deflector sections 38 and 39, the coolant will tend to cool the deflector sections 38 and 39 excessively, resulting in carbon deposits. It is desirable to place a coolant deflector section 48 upstream of the flame deflector sections 38 and 39 to divert the coolant spray from the flame deflector sections 38 and 39. The coolant deflector section 48 has a V-shaped end 49 which is spaced upstream of the flame deflector sections 38 and 39 for deflecting coolant from the flame deflector ends 42 and 46 and has sides 50 and 51 which extend between the flame deflector side walls 40 and 44 and the wall of the valve passage 30 to prevent coolant from contacting such side walls 40 and 44. The side 50 of the coolant deflector 48 and the wall of the valve 20 within the passage 30 define a passageway 52 extending along one side of the deflector 36 and the side 51 of the coolant deflector 48 and the wall of the exhaust valve 20 within the passage 30 define a second passage 53 extending along the deflector 36. The passages 52 and 53 carry coolant past the side ports 28 and 29 in the exhaust valve 20 to prevent such coolant from passing through the side ports 28 and 29. The passages 52 and 53 also protect the flame deflector sections 38 and 39 from being cooled excessively by the coolant sprayed from the nozzle 31. As a consequence, the flame deflector sections 38 and 39 may operate at a sufficiently high temperature to prevent carbon buildup.

The side wall 40 and the end wall 42 on the flame deflector section 38 terminate at a wall 55 upstream of the side port 28. Similarly, the side wall 44 and the end wall 46 of the flame deflector 39 terminate at a wall 56 upstream of the side port 29. The two flame deflector sections 38 and 39 are connected together by spot welding at an interface 57 where such sections abut. The upstream walls 55 and 56 on the flame deflector sections 38 and 39 are shaped to closely engage the exhaust valve 20 upstream of the side ports 28 and 29 when the deflector 36 is pressed into the passage 30. Preferably, the flame deflector 36 is held in place by welding 58 between the exhaust valve 20 and the walls 55 and 56. Walls 59 and 60 are also provided on opposite sides of the coolant deflector section 48 between the V-shaped end 49 and the sides 50 and 51. When the coolant deflector section 48 is positioned over the flame deflector sections 38 and 39, the wall 59 abuts the wall 55 and the wall 60 abuts the wall 56. The walls 55 and 59 and the walls 56 and 60 are held together by welding, as shown at 61.

Although the deflector 36 has been shown as including flame deflector sections 38 and 39 and the coolant deflector section 48, it should be noted that the flame deflector sections 38 and 39 will still function if the coolant deflector section 48 is omitted. The primary function of the coolant deflector section 48 is to prevent excessive cooling of the flame deflector sections 38 and 39 which may result in carbon buildup on the flame deflector sections 38 and 39. It should be appreciated that various other changes and modifications may also be made in the exhaust valve structure without departing from the spirit and the scope of the following claims.

The embodiments of the invention in which an exclusive property or privilege is claimed are defined as follows:

1. In a rotary valve engine including a piston reciprocating in a cylinder, an intake valve and a rotary exhaust valve mounted to rotate within a cylinder head, said cylinder head, said cylinder and said piston defining a combustion chamber, an improved rotary exhaust valve structure comprising a tubular valve body mounted to rotate in said housing, said valve body having an axially directed passage therein connected to an exhaust gas outlet, at least one said port in said valve body positioned for connecting said combustion chamber with said axially directed passage when said valve body is rotated through a predetermined angular segment whereby exhaust gas flows from said combustion chamber through said side port and said axially directed passage to the exhaust gas outlet, deflector means positioned in said passage for directing exhaust gas flow from said side port toward the gas outlet, and means in said passage upstream of said deflector means for directing a liquid coolant spray toward the exhaust gas outlet, said deflector means including means for preventing such coolant spray from entering said side port.

2. An improved exhaust valve structure for a rotary valve engine, as set forth in claim 1, wherein said deflector means includes separate coolant and exhaust gas deflectors, said coolant deflector directing exhaust gas flow from said side port toward the gas outlet, and said coolant deflector directing the coolant spray past said exhaust gas deflector.

3. An improved exhaust valve structure for a rotary valve engine, as set forth in claim 1, wherein said valve body has two diagonally opposing side ports, each of said side ports connecting said combustion chamber with said passage on alternate engine exhaust cycles of the engine, and wherein said deflector means includes means for directing exhaust gas flow through each of said side ports toward the exhaust gas outlet and away from the other of said ports.

4. An improved exhaust valve structure for a rotary valve engine, as set forth in claim 3, wherein said deflector means includes separate coolant and exhaust gas deflectors, said exhaust gas deflector comprising said means for directing exhaust gas flow through each of said side ports toward the exhaust gas outlet, and said coolant deflector including means for shielding said exhaust gas deflector from the liquid coolant spray.

5. An improved exhaust valve structure for a rotary valve engine, as set forth in claim 4, wherein said deflector means further includes means spacing said coolant deflector from said exhaust gas deflector to prevent cooling of said exhaust gas deflector by heat conduction through said coolant deflector to such coolant spray is prevented.

* * * * *